US006857450B2

(12) United States Patent
Rupp et al.

(10) Patent No.: US 6,857,450 B2
(45) Date of Patent: Feb. 22, 2005

(54) HYDROPNEUMATIC PRESSURE RESERVOIR

(75) Inventors: Gernot Rupp, Eppelborn (DE); Markus Lehnert, Dillingen (DE); Herbert Baltes, Losheim (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 0 days.

(21) Appl. No.: 10/465,999

(22) PCT Filed: Mar. 9, 2002

(86) PCT No.: PCT/EP02/02626

§ 371 (c)(1),
(2), (4) Date: Jun. 30, 2003

(87) PCT Pub. No.: WO02/079653

PCT Pub. Date: Oct. 10, 2002

(65) Prior Publication Data

US 2004/0045615 A1 Mar. 11, 2004

(30) Foreign Application Priority Data

Mar. 31, 2001 (DE) ..... 101 16 235

(51) Int. Cl.[7] ..... F16L 55/04
(52) U.S. Cl. ..... 138/30; 138/26; 220/721
(58) Field of Search ..... 138/30, 31, 26; 220/721

(56) References Cited

U.S. PATENT DOCUMENTS 4,321,949 A * 3/1982 Mercier ..... 138/30

FOREIGN PATENT DOCUMENTS

| | | | |
|---|---|---|---|
| EP | 4057 A1 * | 9/1979 | ..... E03B/11/08 |
| EP | 1031729 | 8/2000 | |
| GB | 1023726 | 3/1966 | |
| GB | 2003551 | 3/1979 | |
| JP | 09004601 | 1/1997 | |

* cited by examiner

*Primary Examiner*—Patrick Brinson
(74) *Attorney, Agent, or Firm*—Roylance, Abrams, Berdo & Goodman L.L.P.

(57) ABSTRACT

A hydropneumatic pressure reservoir (1) forms a housing from at least two housing shells (3, 5) connected together. At least the end region of the one housing shell (5) includes an outwardly-extending, funnel-like guide surface between its free end and a sealing element for bringing together the two housing shells (3, 5). At least on elastic sealing element (41) is provided on at least one retaining surface for generation of a tensioning force on the boundary region (21) of the membrane (13). A simplified construction with improved sealing in the critical connection of the pressure reservoir is achieved.

13 Claims, 3 Drawing Sheets

HYDROPNEUMATIC PRESSURE RESERVOIR

FIELD OF THE INVENTION

The present invention relates to a hydropneumatic pressure reservoir having a housing separating the interior of the reservoir from the external environment. This housing comprises at least two housing shells connected to each other, and has a cross-section defining a longitudinal axis. A partition separdtes the interior of the housing into two chambers, a gas chamber and a liquid chamber. The partition is in the form of a gas-tight diaphragm clamped at its circumferential edge area to form a seal with the interior wall of the housing by a retaining device. The retaining device has retaining surfaces which receive the edge area of the diaphragm between them. At least one energy storage element generates tension (clamping) forces between edge area and retaining surfaces. At least one of the retaining surfaces is formed by a wall component of one of the housing shells. The retaining surfaces extending equidistant from each other over the entire area of their surfaces to form an annular gap between them which has a clear gap width which remains the same over its axial extent. The retaining surface situated externally in relation to the longitudinal axis on one of the housing shells is part of the jacket surface of a cone whose tip is positioned on the longitudinal axis so that this retaining surface is separated from the longitudinal axis by the greatest axial distance at its end facing the other housing shell.

BACKGROUND OF THE INVENTION

Hydropneumatic pressure reservoirs are disclosed, for example, in DE 25 34 361 B2. Because of the very narrow tolerances, such as must be observed in the case of wall components used in conjunction with each other in the connecting area of the housing shells and of the surfaces coming in contact with the edge area of the diaphragm, installation of the diaphragm and assembly of the housing shells tend to be a relatively difficult process. Because of the precise fit required, the smallest errors in alignment or inclination relative to the longitudinal axis during assembly of the components result in disruption of the assembly process or even in damage from misalignment or tilting.

EP 1 031 729 A2 discloses a generic hydropneumatic pressure reservoir, with a retaining device for the partition or separating diaphragm comprising a self-contained fastening ring which fastens two housing shells held together under tension. The fastening ring, as the retaining device, forces a diaphragm bead on the end side over a flange-like metal ring into the associated seat in the lower housing shell of the reservoir. In the area of the respective bead seat for the partition or separating diaphragm, the housing shells are cylindrical in shape on their guide surfaces facing each other, and consequently, are in contact with each other. The fastening ring and the lower housing shell extend over a predetermined area below the fastening bead with retaining surfaces extending parallel to and equidistant from each other to delimit a gap, and thus, maintain the partition over a predetermined distance. If the housing shells come in contact with each other during assembly of the disclosed reservoir, contact mismatch may occur even with precisely worked guide and retaining surfaces. Such contact mismatch impairs the clamping of the diaphragm and its later fastening in the reservoir, and may also greatly complicate assembly. The sealing ring mounted between the cylindrical guide surfaces of the two housing halves, which accordingly is positioned outside the diaphragm fastening point, is subjected to no additional clamping force increasing the sealing force. Thus, tightness problems may arise especially in the event of inaccurate clamping within the framework of the assembly as described.

SUMMARY OF THE INVENTION

Objects of the present invention are to provide a hydropneumatic pressure reservoir having a construction permitting especially simple assembly and avoiding the disadvantages in conventional hydropneumatic pressure reservoirs, as described above.

The foregoing objects are basically obtained by a hydropneumatic pressure reservoir where at least the end area of one housing shell has between its free end and the respective sealing element a funnel-shaped guide surface expanding outward for bringing the two housing shells together. At least one flexible sealing element is provided on at least one retaining surface for generation of a clamping force acting on the edge area of the diaphragm. In this manner, the retaining surfaces extend equidistant from each other over the entire area of their surface to form between them an annular gap. The clear width of the annular gap remains the same over its axial extent.

According to the present invention the end areas of the housing shells to be connected can be configured so that the end area of the housing shell, which forms the external retaining surface for clamping the diaphragm, forms a guide surface widening outward like a funnel when the two housing shells are brought together. Since the other retaining surface associated with the other housing shell, the internal retaining surface in relation to the longitudinal axis, is equidistant from the other retaining surface in formation of the annular gap seating the edge area of the diaphragm, that is, with the housing halves in the assembled state, a self-centering occurs in the process of assembly of the housing shells because of the funnel-shaped configurations of the guide surfaces. In this manner, trouble-free assembly by simple means is made possible, in an especially precisely defined contact situation for the edge of the partition or separating diaphragm. In addition, in the overall situation as presented, sure sealing between the interior of the reservoir and the external environment is achieved as a result of incorporation of the flexible sealing element exerting a direct effect on the edge area of the diaphragm. Since, in addition, the sealing element may affect the associatable edge area of the diaphragm by application of an active pretensioning force, the sealing force is appreciably improved and the position of the diaphragm in relation to its edge area is precisely defined. This arrangement favors lengthening of the service life of the diaphragm as a whole.

In an especially preferred embodiment of the pressure reservoir of the present invention, one housing shell has another guide surface narrowing inward in the form of a funnel for establishment of contact with the other housing shell. When the two housing shells have been brought into contact with each other, the two guide surfaces are kept in contact with each other and/or equidistant from each other. As a result, precise centering of one housing shell relative to the other housing shell is effected. In close-tolerance centering, the guide surfaces may also be used in creation of other sealing surfaces of the reservoir.

In another preferred embodiment of the pressure reservoir of the present invention, the outer retaining surface extends in length with the same inclination as the guide surface associated with it. If the centering is precisely adjusted, the guide surfaces in question may in this way participate in configuration of other sealing surfaces of the reservoir.

In another preferred embodiment of the pressure reservoir of the present invention, the outer retaining surface is in the form of an extension and extends with the same inclination relative to the guide surface associated with it. The inner retaining surface preferably extends in parallel with the outer retaining surface, and is mounted offset one step inward toward the longitudinal axis of the reservoir. On the basis of this configuration, the retaining surfaces may be designed as continuations of the guide surfaces to appreciably lower the production costs.

In one preferred embodiment of the pressure reservoir, the retaining device may be formed directly from the two housing shells, and an additional fastening ring may be entirely omitted. While retaining the advantages of the present invention, another embodiment can produce the respective configuration by using a fastening ring, although this configuration increases the variety of components and accordingly the production costs.

In another preferred embodiment of the pressure reservoir of the present invention, the length of each guide surface is shorter than the length of each associated retaining surface. This configuration guarantees both availability of retaining surfaces of a size which serves to effect secure fastening of the diaphragm material, while not impairing the centering situation by way of the guide surfaces on the other side. It also ensures the respective centering over the entire circumference.

The preferred range of the angle at which the outlying retaining surface extends outward in the form of a funnel relative to the longitudinal axis is 4° to 10°, preferably 5° to 6°.

The advantage of the simplified assembly remains undiminished, regardless of the method employed to configure the force reservoir element which is used to generate the clamping force required to clamp and seal the edge area of the diaphragm, with the gap width kept constant.

The retaining surface positioned inside relative to the longitudinal axis may be, for example, in the form of a projection on one housing shell which may be inserted into the other housing shell. If, in this case, the projection is designed to be integral with the other housing shell, at least one flexible sealing element mounted between at least one retaining surface and the edge area of the diaphragm may be provided as the force storage element generating the clamping force between the edge area of the diaphragm and the retaining surfaces.

As an alternative, the projection present on one housing shell, which may be inserted into the other housing shell and forms the inner retaining surface, may also be in the form of a clamp ring connected to the pertinent housing shell by a spring-mounted intermediate element. The intermediate element serves as force storage element for generation of the clamping force acting on the edge area of the diaphragm. In both instances, the circumferential edge components, which may be inserted into a housing shell, extend inward at a small angle of taper and accordingly are of a configuration well-suited for easy and reliable assembly.

In one preferred exemplary embodiment, the edge area of the diaphragm has a bead-like thickening seated between the retaining surfaces. An elastic sealing ring, adjoining the end edge or spray applied to this end edge as sealing element, generates a clamping force between the bead-like thickening and support surfaces formed on both ends of the housing shell and extending transversely to the retaining surfaces.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
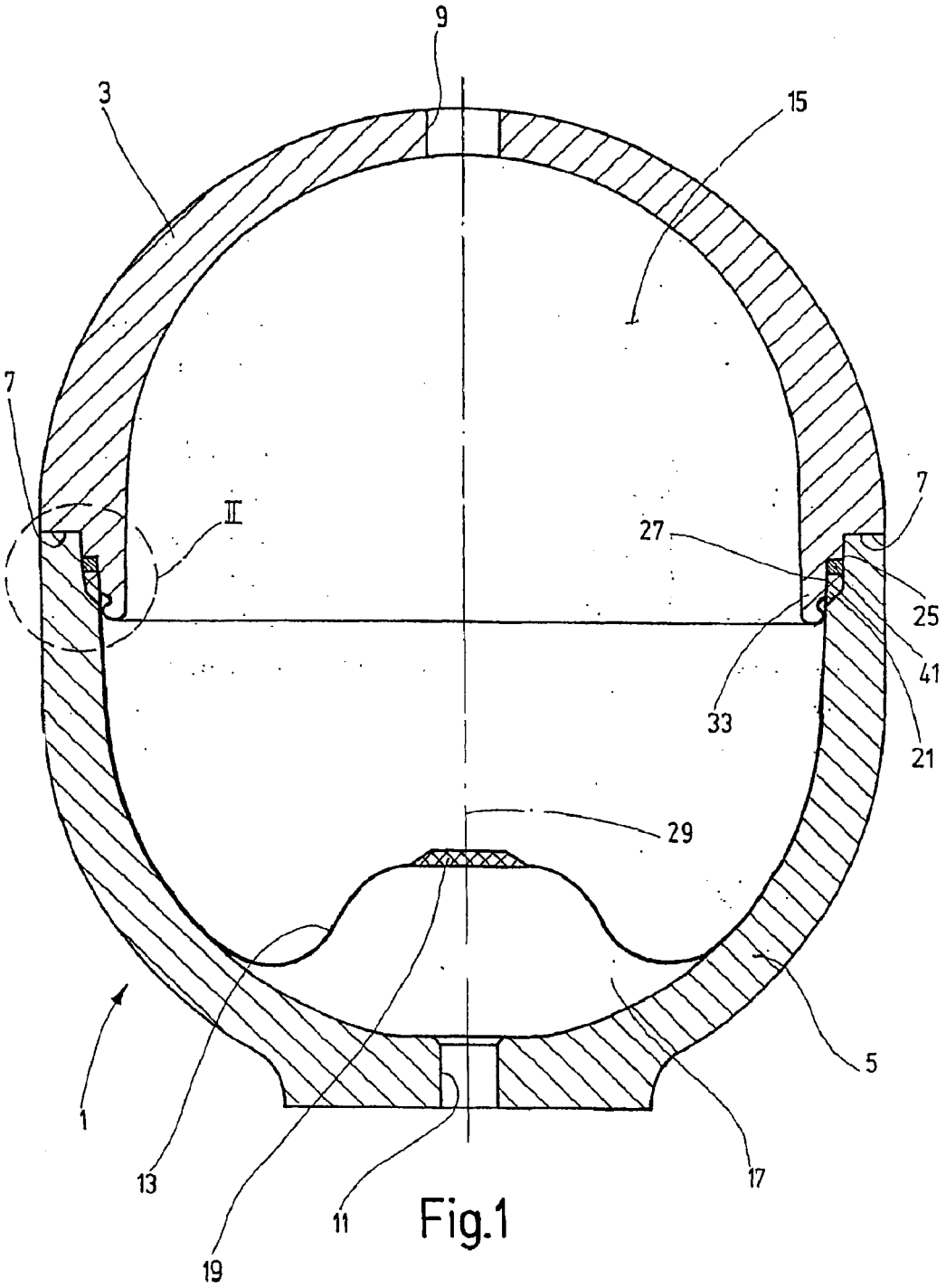
FIG. 1 is a side elevational view in section of a hydropneumatic pressure reservoir in accordance with a first embodiment of the present invention.

A hydropneumatic pressure reservoir 1, in FIG. 1, has two housing shells 3 and 5 which are approximately hemispherical in shape and are connected to each other at a seam 7. As is customary in such pressure reservoirs, the housing shells 3 and 5 are connected to each other at the seam 7 by electron beam welding or laser welding so as to be gas-tight. Each of the housing shells 3 and 5 has an opening 9 or 11, for a connection mounting (not shown) producing connections to a gas intake and refill system or a hydraulic system (also not shown), respectively.

The interior of the housing is divided by a partition, in the form of a gas-tight diaphragm 13, into an upper gas chamber 15, in FIG. 1, and lower liquid chamber 17 adjoining the opening 11. The diaphragm 13 may be in the form of an elastomer material or, preferably, of a plastic material. It may be a monolayer diaphragm formed of a polyamide such as PA6 or a polyamide blend such as polyamide-polyolefine, or of polyethylene terephthalate, polyethylene naphthalate, or polyvinylidene chloride. In the case of a multilayer diaphragm, the plastics in question may be provided as a sealing layer to which a cover layer or layers is or are applied.

The diaphragm 13 is shown in FIG. 1 in an incompletely extended state. In the completely extended state, which corresponds to the smallest volume of the liquid chamber 17, a reinforcement 19 applied by adhesive or sprayed on, acting as a sort of valve disk, is positioned above the inner edge of the opening 11. In this position, reinforcement 19 would not only effect sealing, but also would prevent forcing of the diaphragm 13 into the opening 11 by the pressure prevailing in the gas chamber 15. The reinforcement 19 may also be in the form of a thickening of the material of the diaphragm 13 itself.

Figure 2:
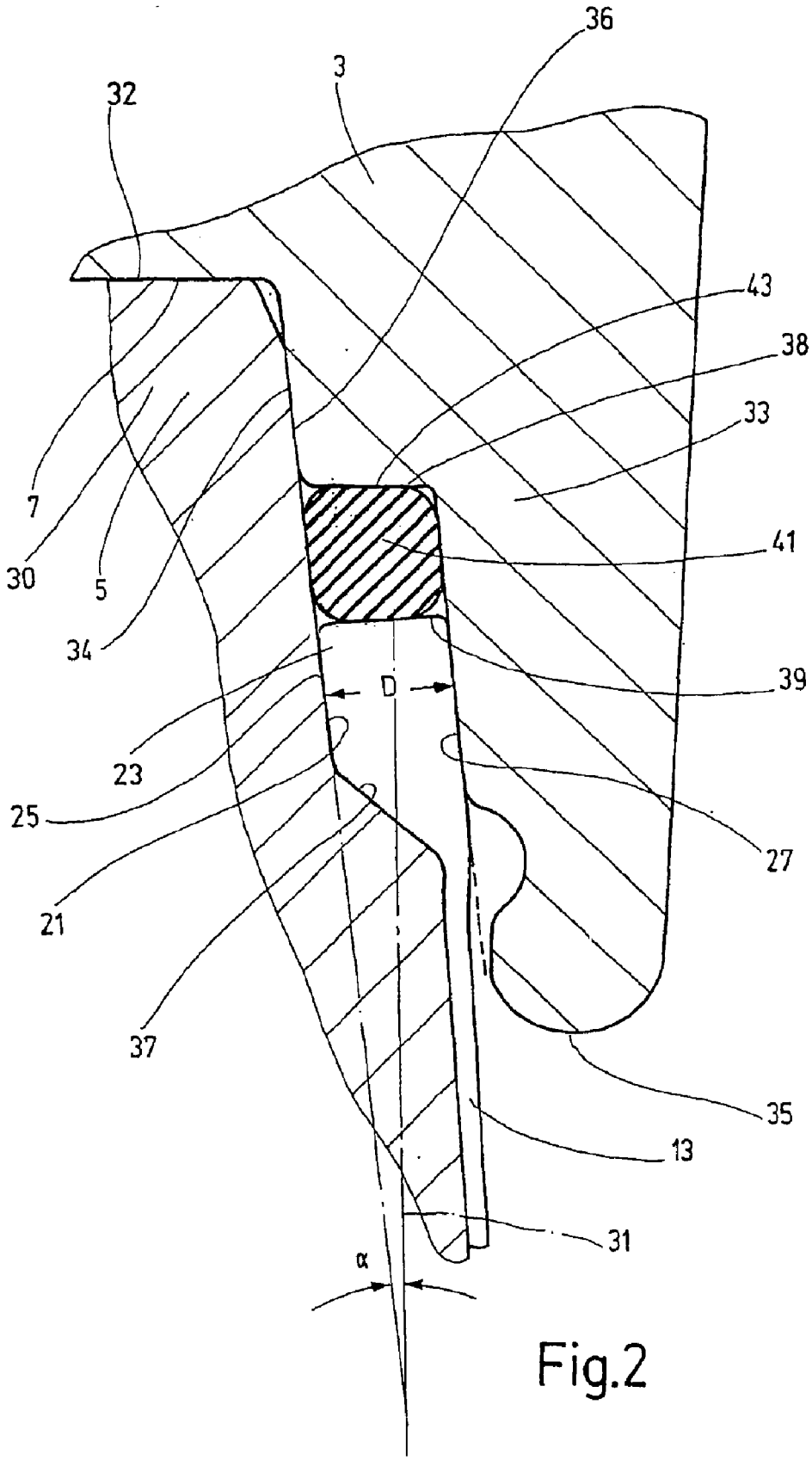
FIG. 2 is an enlarged, partial side elevational view in section of the pressure reservoir area designated as II in FIG. 1.

FIG. 2 shows the area designated as II in FIG. 1 on a larger scale so as to present in greater detail the configuration of the edge area 21 of the diaphragm 13 and of the retaining device for clamping the diaphragm 13. In the first embodiment shown in FIGS. 1 and 2, the edge area 21 of the diaphragm 13 has a bead-like thickening 23 seated between two retaining surfaces, a first retaining surface 25 associated with the housing shell 5 and a second retaining surface 27 associated with the housing shell 3. The retaining surfaces 25 and 27 extend over the entire circumference of the pressure reservoir housing equidistant from each other. An annular gap is formed between retaining surfaces 25 and 27 for seating of the edge area 21 of the diaphragm 13. This annular gap is of a constant clear gap width D over its axial extent (FIG. 2).

In FIG. 1, the longitudinal axis 29 of the pressure reservoir 1 is defined by the approximately spherical form of the housing shells 3 and 5. The longitudinal direction of the pressure reservoir defined by this longitudinal axis 29 is illustrated in FIG. 2 by a guide line 31. Guide line 31 is in parallel with the longitudinal axis 29. In FIG. 2, the retaining surface 25, positioned on the outside in relation to or more spaced from the longitudinal axis 29, is inclined at a very acute angle $\alpha$ to the longitudinal direction indicated by the guide line 31, that is, relative to the longitudinal axis 29. This outer retaining surface 25 consequently is part of the jacket or outer surface of a cone whose tip or apex lies on the longitudinal axis 29 of the pressure reservoir. FIG. 2 shows that the outer retaining surface 25 inclines at a small angle $\alpha$, which is about 4° to 10°, to the longitudinal axis 29 so that the retaining surface 25 is separated or spaced from the longitudinal axis 29 by the greatest radial distance at its upper end in FIG. 2, that is, at its end facing or closest to the housing shell 3. The upper end of the lower housing shell 5 shown in FIGS. 1 and 2 facing the housing shell 3 accordingly tapers downwardly slightly on the edge side in the form of a funnel. The end component of the other, upper, housing shell 3 to be inserted into the slightly expanded open end of the housing shell 5, which end component is designed in a suitable, complementary configuration in order to define the inner retaining surface 27. The projection 33 of the housing shell 3 is inserted into the housing shell 5. The upper housing shell has, in its lower end area projecting during the connection process, an external diameter which is smaller than that of the opening at the open end edge of the lower housing shell 5, forming a sort of "insertion funnel." Assembly of the housing shells 3 and 5 is accordingly simple and free of problems, since the projecting end area 35 of the housing shell 3 can be immediately fitted over the thickening 23 of the edge area 21 of the diaphragm 13 applied to the retaining surface 25. As seen in FIG. 2, the outer retaining surface 25 has, on its lower end shown in the figure, a support surface 37 extending transversely and diagonally relative to this retaining surface. This support surface 37 forming a seat for the thickening to prevent displacement along the retaining surface 25.

Lower housing shell 5 is provided in the direction of its outer or upper end with a guide surface 34 widening slightly outwardly as a funnel for bringing the two housing shells 3, 5 together. The upper housing shell 3 is provided with another guide surface 36 narrowing inward also as a funnel. The two guide surfaces 34, 36 are in contact with each other or are equidistant when the two housing shells 3,5 have been brought or are fully mated together. In addition, the outer retaining surface 25 is mounted to extend longitudinally, and thus, at the same angle of inclination as the guide surface 34 associated with it. The inner retaining surface 27, in turn, extends in parallel with the outer retaining surface 25, being offset inward relative to the longitudinal axis 29 by a step 38. The length of each guide surface 34, 36 is shorter than the length of each associated retaining surface 25, 27. In addition, guide surface 34 of the lower housing shell adjoins the free upper end 32 of that housing shell.

The retaining device for the diaphragm partition may be formed directly from the two housing shells 3, 5 or at least in part by a self-contained fastening ring (not shown). The fastening ring may be introduced into one of the two housing shells 3, 5, in particular into the lower housing shell 5.

In the embodiment illustrated in FIGS. 1 and 2, the projection 33 is integral with the housing shell 3 at the top in the figure. The projection 33 forms a rigid connection with the housing shell 5. An elastic sealing element 41 adjoining the end edge 39 of the thickening 23 is provided as force storage element for generation of a clamping force for clamping and sealing of the edge area 21 of the diaphragm 13. This sealing element is in the form of an O-ring clamped between the retaining surfaces 25 and 27, and applies to the end edge 39 of the thickening 23 a clamping force acting in the axial direction between a support surface 43 extending transversely to the retaining surface 27 and the support surface 37 extending transversely to the retaining surface 25. In addition, the sealing element 41 effects sealing both from the retaining surface 25 and from the retaining surface 27. The sealing element 41 is applied to the end edge 39 of the thickening 23 of the diaphragm 13 by adhesion or by spray application.

Figure 3:
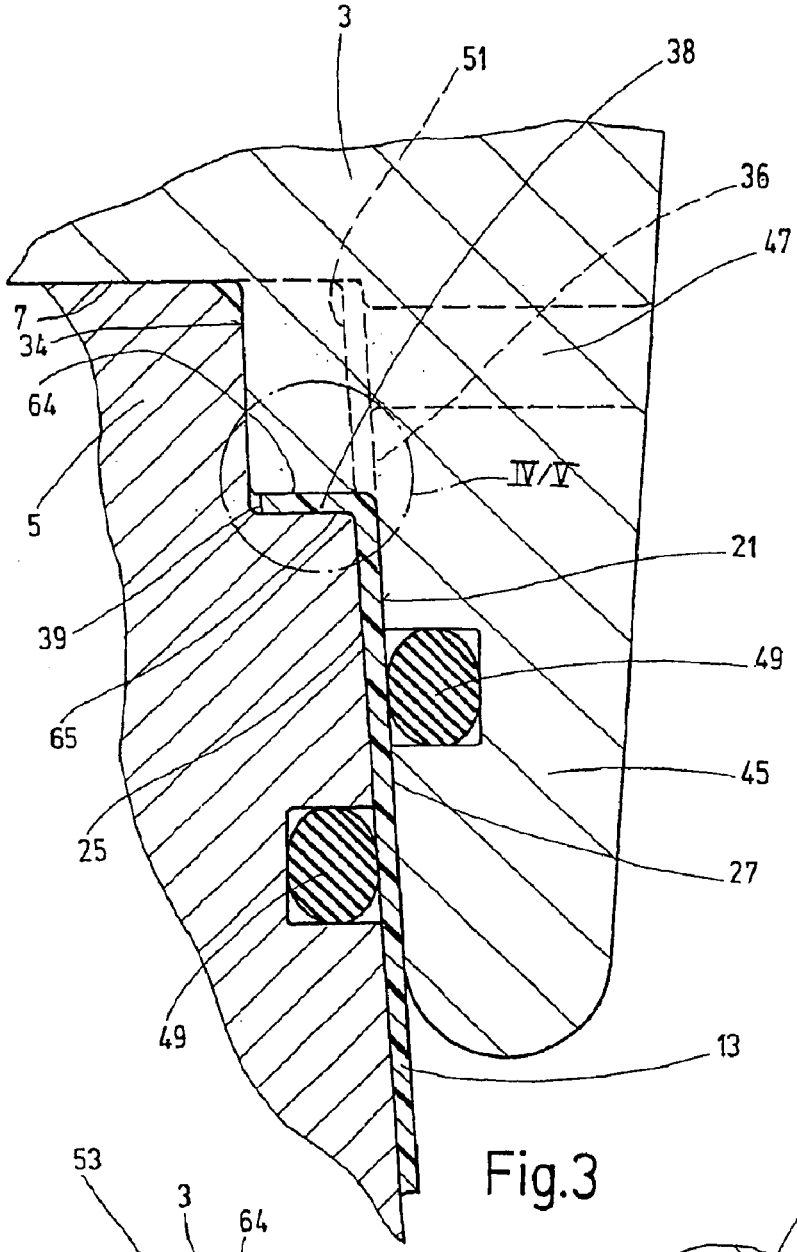
FIG. 3 is an enlarged, partial side elevational view in section of an area of a pressure reservoir, corresponding to the area of FIG. 2, in accordance with a second embodiment of the present invention.
Figure 4:
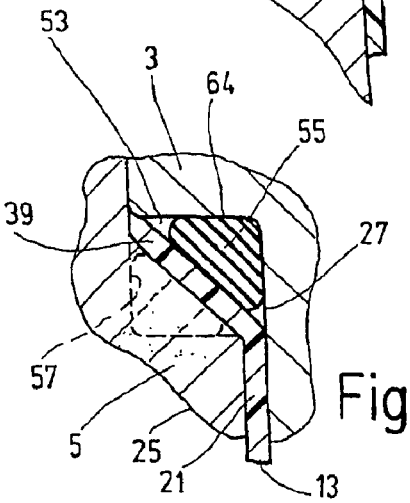
FIGS. 4 and 5 are enlarged, partial side elevational views section of the area identified as IV and V in FIG. 3, but in accordance with third and fourth embodiments of the present invention, respectively
Figure 5:
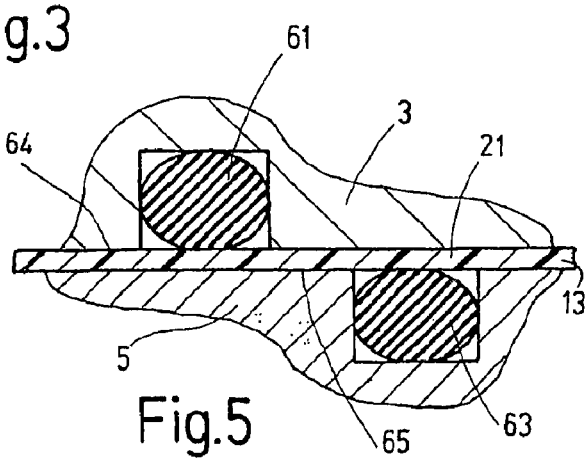

FIGS. 3 to 5 illustrate other embodiments of the configuration of the retaining device for clamping and sealing the edge area 21 of the diaphragm 13. The edge area 21 in these cases has no thickening on the end side, contrary to the thickening 23 provided in the first embodiment.

In the second embodiment illustrated in FIG. 3, the projection of the upper housing shell 3, which projects into the lower housing shell 5, is not designed to be integral with the housing shell 3, as was the case for the projection 33 of the first embodiment. Rather a clamp ring 45, associated with the housing shell 3, is provided as the projection. This clamp ring 45 is connected to the upper housing shell 3 by a spring-loaded intermediate element 47. The intermediate element serves as force storage element, and generates an axial force pretensioning the clamp ring 45 into the housing shell 5 when the pressure reservoir has been assembled. This axial force acts as clamping force between the retaining surfaces 25 and 27, which are essentially similar to the retaining surfaces 25 and 27 of the first embodiment and receive the edge area 21 of the diaphragm 13 to be seated between them. In addition, sealing elements 49, e.g., O-rings, are mounted on both sides of the edge 21 of the diaphragm 13, and serve both to provide sealing and act as additional force storage elements generating a clamping force.

Broken lines 51 in FIG. 3 illustrate an extended course of the edge area 21 of the diaphragm 13 up to the area of the seam 7 of the housing shells. As an alternative, a solid line illustrates a variation in which the end area 39 of the diaphragm 13 is folded outward. This area is identified by a circle in FIG. 3 designated as IV/V. Two optional configurations of this area IV/V are illustrated in FIGS. 4 and 5 as third and fourth embodiments.

FIG. 4 shows end area 39 folded diagonally outward. In the upper housing shell 3 shown, annular groove 53 seats a sealing element in the form of a shaped sealing ring 55, in particular one in the form of an O-ring. The sealing ring is supported by the inner retaining surface 27 and by the surface 64 extending transversely to the retaining surface 27 to form a clamping force and a seal on the adjoining surface on the end area 39 of the diaphragm 13. FIG. 4 illustrates, as an alternative construction indicated by broken lines 57, the formation of another annular gap on the upper end of the outer retaining surface 25 with a sealing element corresponding to the sealing ring 55 being seated in this annular gap.

Lastly, FIG. 5 illustrates a fourth embodiment. In the area identified as IV/V in FIG. 3, sealing elements 61 and 63 are seated in annular grooves on both sides of the folded outward edge of the diaphragm 13. These sealing elements 61 and 63 in turn serve both as additional force storage elements for clamping force generation and as seals. The respective sealing elements are preferably used in pairs, sealing off from the gas side and from the hydraulic side. With an appropriate design of the diaphragm 13, the sealing elements can perform exclusively the function of sealing on the oil side.

While various embodiments have been chosen to illustrate the invention, it will be understood by those skilled in the art that various changes and modifications can be made therein without departing from the scope of the invention as defined in the appended claims.

What is claimed is:

1. A hydropneumatic pressure reservoir, comprising:

a housing having first and second housing shells with said first housing shell being connected to said second housing shell, and having an interior separated from an external environment, said housing having an inner wall and a cross-section defining a longitudinal axis;

a partition dividing said interior into a gas chamber and a liquid chamber, said partition being a gas-tight diaphragm with a circumferential edge area clamped and sealed to said inner wall of said housing;

first and second retaining surfaces seating said edge area therebetween, said first retaining surface being formed by a wall component of said first housing shell, said retaining surfaces being equidistant from one another over entire surface areas thereof and forming an annular gap with a constant gap width of an axial extent thereof, said first retaining surface being external relative to said longitudinal axis and being part of a conical surface with an apex on said longitudinal axis such that said first retaining surface is spaced by a greatest distance from said longitudinal axis at an end thereof facing said second housing shell;

an elastic sealing element between and generating a clamping force on said edge area and one of said retaining surfaces; and a guide surface on an end area of said first housing shell between a free end thereof and said elastic sealing element, said guide surface flaring outwardly in a funnel form for moving said housing shells together.

2. A hydropneumatic pressure reservoir according to claim 1 wherein said second housing shell has a second guide surface narrowing inwardly in a funnel form; and said first and second guide surfaces are one of in contact with and equidistant form one another when said first and second housing shells are mated.

3. A hydropneumatic pressure reservoir according to claim 1 wherein said first retaining surface and said first guide surface extend axially at equal inclinations relative to said longitudinal axis.

4. A hydropneumatic pressure reservoir according to claim 3 wherein said second retaining surface is parallel with said first retaining surface and is offset inward by one step toward said longitudinal axis.

5. A hydropneumatic pressure reservoir according to claim 1 wherein said edge are is retained directly by said housing shells.

6. A hydropneumatic pressure reservoir according to claim 1 wherein a clamping ring on at least one of said housing shells retains said edge area.

7. A hydropneumatic pressure reservoir according to claim 2 wherein said first and second guide surfaces are shorter than said first and second retaining surfaces, respectively.

8. A hydropneumatic pressure reservoir according to claim 1 wherein said first retaining surface is inclined at an angle of 4° to 10° relative to said longitudinal axis.

9. A hydropneumatic pressure reservoir according to claim 1, wherein said second retaining surface is positioned inside said first retaining surface and is on a projection of said second housing shell inserted in said first housing shell.

10. A hydropneumatic pressure reservoir according to claim 1 wherein said edge area comprises a bead thickening seated between said retaining surfaces; and said elastic sealing element comprises an elastic sealing ring on an end edge of said bead thickening generating a clamping force between said bead thickening support surfaces extending transversely to said retaining surfaces on said housing shells.

11. A hydropneumatic pressure reservoir according to claim 9 wherein said projection is a clamp ring connected to said second housing shell by a spring loaded gas-sealing intermediate element generating a pretensioning force on said second retaining surface seeking to displace said second retaining surface in an axial direction.

12. A hydropneumatic pressure reservoir according to claim 1 wherein said edge area comprises an end section folded over outwardly and projecting over an end of said first retaining surface, said, end section seating said end area in a space between seating surface formed on said housing shells, said seating surfaces lying in planes extending transversely to said longitudinal axis.

13. A hydropneumatic pressure reservoir according to claim 12 wherein at least one elastic sealing element is on one of said seating surfaces, forms a seal on one of said end sections and said diaphragm, and generates a clamping force pressing said- end section against an opposite one of said seating surfaces.

* * * * *